US006435073B1

(12) United States Patent
Chen

(10) Patent No.: US 6,435,073 B1
(45) Date of Patent: Aug. 20, 2002

(54) OUTER CASING FOR A HYDRAULIC CYLINDER

(76) Inventor: Tsung-Yu Chen, No. 23-4, Ting-Liao, San-Ho Tsun, Shiu-Shang Hsiang, Chiayi Hsien (TW)

( * ) Notice: Subject to any disclaimer, the term of this patent is extended or adjusted under 35 U.S.C. 154(b) by 0 days.

(21) Appl. No.: 09/708,548

(22) Filed: Nov. 9, 2000

(51) Int. Cl.[7] ..... A63B 22/14; F01B 7/20

(52) U.S. Cl. ..... 92/51; 482/53

(58) Field of Search ..... 92/51, 86; 482/52, 482/53

(56) References Cited

U.S. PATENT DOCUMENTS 4,202,514 A * 5/1980 Chen ..... 92/5 R
5,628,709 A * 5/1997 Chen ..... 482/53

* cited by examiner

*Primary Examiner*—Edward K. Look
*Assistant Examiner*—Thomas E. Lazo
(74) *Attorney, Agent, or Firm*—Rosenberg, Klein & Lee

(57) ABSTRACT

A combination of an outer casing and a hydraulic cylinder includes a tubular and transparent tube which has two open ends and the hydraulic cylinder is received in the outer casing. A fitting and a piston rod on two ends of the hydraulic cylinder respectively extend from the two open ends of the outer casing.

1 Claim, 2 Drawing Sheets

OUTER CASING FOR A HYDRAULIC CYLINDER

FIELD OF THE INVENTION

The present invention relates to an outer casing for a hydraulic cylinder used on exercise device such as and the casing is made of transparent material so that the user of the exercise device can see how the cylinder works.

BACKGROUND OF THE INVENTION

A conventional hydraulic cylinder is composed of a tubular body in which a piston is movably received and a piston rod is connected to the piston so that when the hydraulic fluid is entered into the tubular body, the piston is moved by the fluid to output work. A main problem about maintenance is leakage of the hydraulic fluid which is moved by pressure so that the hydraulic fluid could leak from any possible crack or gap in the fitting of the cylinder or the tubular body itself. Once the hydraulic fluid leaks from the tubular body, the work output from the piston is reduced. Generally, an outer casing is mounted to the tubular body so as to prevent the fluid, lubricant or the like from contacting, other objects around the hydraulic cylinder. However, because the outer casing is usually made by iron so that it could get rusted and cannot see whether the hydraulic cylinder has a leakage problem or not.

The present invention intends to provide an outer casing mounted to the hydraulic cylinder and the outer casing is made of transparent material so that it will not get rusted and the users can see the hydraulic cylinder.

SUMMARY OF THE INVENTION

In accordance with one aspect of the present invention, there is provided a combination of an outer casing and a hydraulic cylinder, wherein the outer casing is a tubular and transparent tube which has two open ends and the hydraulic cylinder is received in the outer casing. A fitting of the hydraulic cylinder extends from one of the two open ends of the outer casing and a piston rod of the hydraulic cylinder extends from the other open end of the outer casing.

The primary object of the present invention is to provide an outer casing of a hydraulic cylinder wherein the outer casing is made of transparent material so that the users can check the leakage problems of the hydraulic cylinder.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
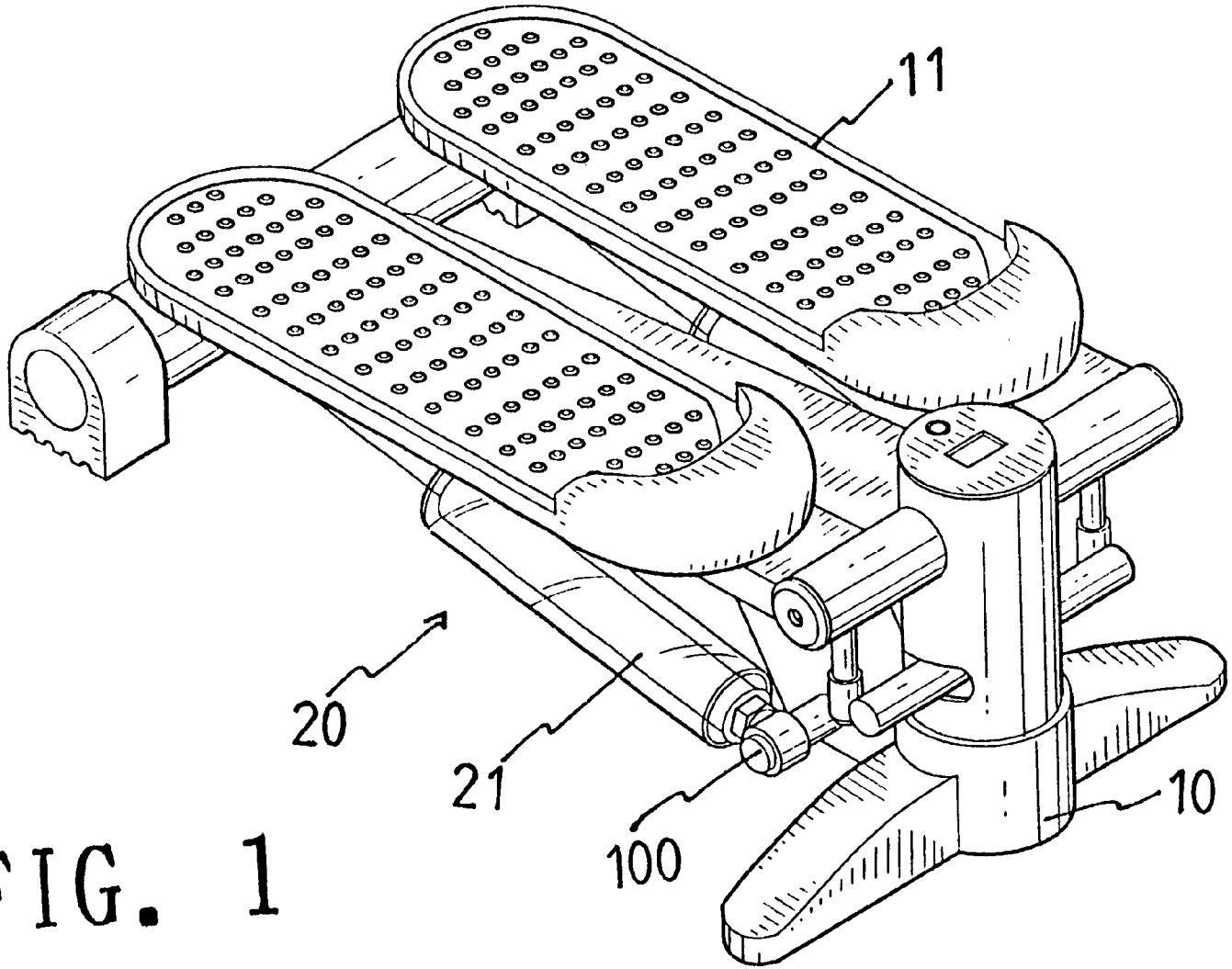
FIG. 1 is a perspective view to show a stationary step machine having two hydraulic cylinders to which two respective outer casings are mounted.
Figure 2:
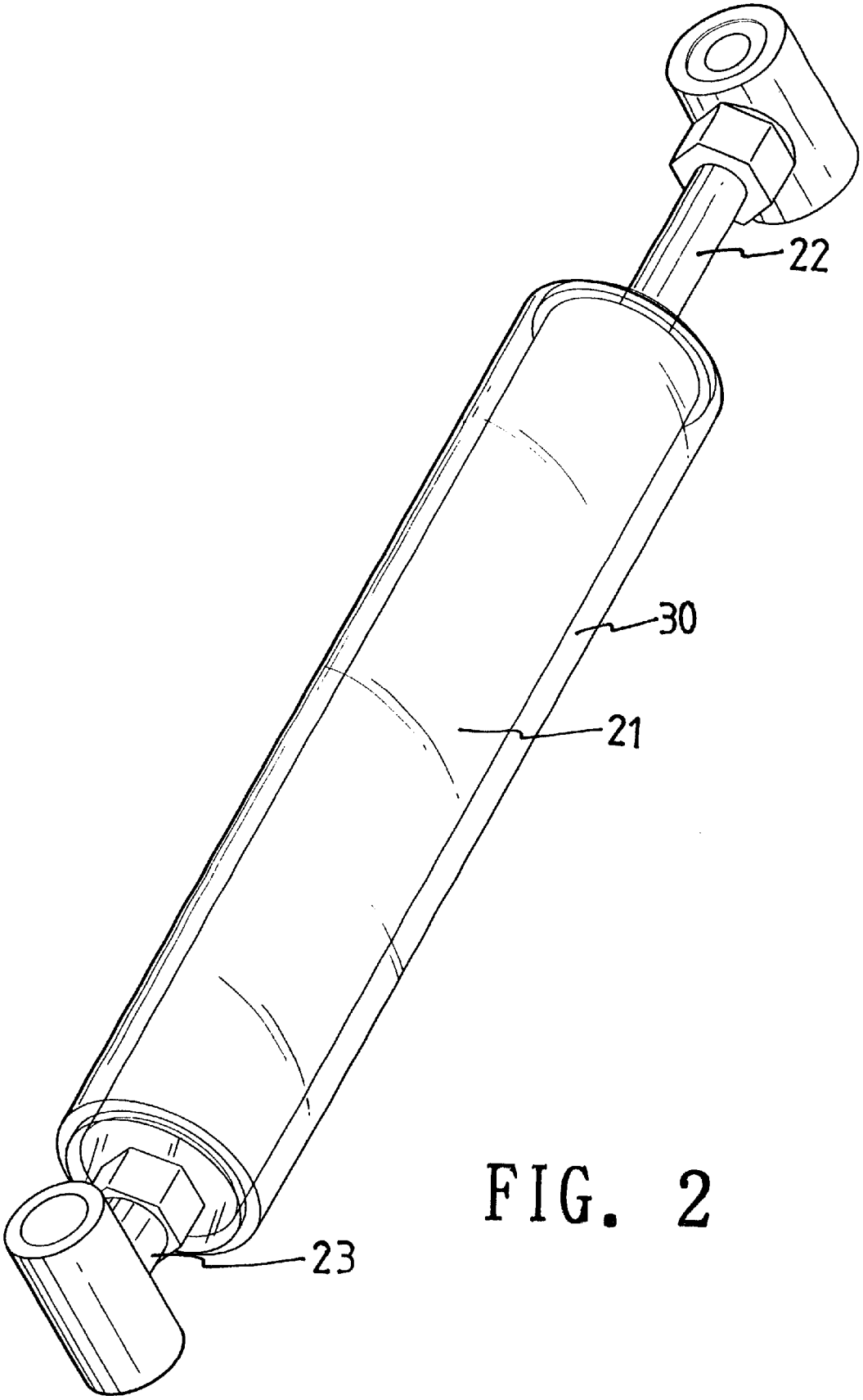
FIG. 2 is a perspective view to show a combination of a hydraulic cylinder and an outer casing of the present invention.

Referring to FIGS. 1 and 2, the combination of an outer casing 30 and a hydraulic cylinder 21 of the present invention is illustrated and used on a stationary step machine which has a post 10 with two pedals 11 pivotally connected to the post 10. Each of the two pedals 11 is connected to a hydraulic cylinder 21 which is connected between the pedal 11 and a rod 23 on the post 10. Therefore, when a user steps on the two pedals 11 by his/her two feet, the two hydraulic cylinders 21 are actuated alternatively to practice muscles of the feet.

An outer casing 30 is a tubular and transparent tube which has two open ends and a hydraulic cylinder 21 is received in the outer casing 30. A fitting 23 of the hydraulic cylinder 21 extends from one of the two open ends of the outer casing 30 and includes a shank portion and a tube which is transversely connected to the shank. The tube is pivotally connected to a fixed rod extending from the step machine. A piston rod 22 of the hydraulic cylinder 21 extends from the other open end of the outer casing 30. Therefore, the users can clearly see how the hydraulic cylinder 21 works and check the leakage problems whenever the users want to.

While we have shown and described various embodiments in accordance with the present invention, it should be clear to those skilled in the art that further embodiments may be made without departing from the scope and spirit of the present invention.

What is claimed is:

1. A combination of an outer casing and a hydraulic cylinder, wherein said outer casing is a tubular and transparent tube which has two open ends, said hydraulic cylinder received in said outer casing, a fitting of said hydraulic cylinder extending from one of said two open ends of said outer casing and including a shank portion connected to the hydraulic cylinder and a tube which is transversely connected to the shank, said tube adapted to be pivotally connected to a fixed rod extending from a step machine, a piston rod of said hydraulic cylinder extending from the other open end of said outer casing.

* * * * *